US006692412B2

(12) United States Patent
Chen et al.

(10) Patent No.: US 6,692,412 B2
(45) Date of Patent: Feb. 17, 2004

(54) INTERACTIVE EXERCISE APPARATUS STRUCTURE

(76) Inventors: Shu-Yi Chen, No. 733, Sec. 4, Yan Hai Road, Fu Hsing Hsiang, Chang Hua Hsien (TW); Wan-Chen Hsieh, 6F-1, No. 100, Sec. 2, Lin Sen Road, East Area, Tainan City (TW)

( * ) Notice: Subject to any disclaimer, the term of this patent is extended or adjusted under 35 U.S.C. 154(b) by 255 days.

(21) Appl. No.: 09/873,326

(22) Filed: Jun. 5, 2001

(65) Prior Publication Data

US 2002/0183172 A1 Dec. 5, 2002

(51) Int. Cl.[7] ..... A63B 21/068

(52) U.S. Cl. ..... 482/96; 482/72; 482/132; 482/135

(58) Field of Search ..... 482/72, 95, 96, 482/101, 132, 135

(56) References Cited

U.S. PATENT DOCUMENTS

| | | | | | |
|---|---|---|---|---|---|
| 339,638 | A | * | 4/1886 | Goldie | 482/96 |
| 3,892,404 | A | * | 7/1975 | Martucci | 482/96 |
| 4,004,801 | A | * | 1/1977 | Campanaro et al. | 482/96 |
| 4,101,124 | A | * | 7/1978 | Mahnke | 482/96 |
| 4,383,684 | A | * | 5/1983 | Schliep | 482/96 |
| 4,911,438 | A | * | 3/1990 | Van Straaten | 482/96 |
| 5,029,848 | A | * | 7/1991 | Sleamaker | 482/96 |
| 5,169,363 | A | * | 12/1992 | Campanaro et al. | 482/96 |
| 5,354,251 | A | * | 10/1994 | Sleamaker | 482/96 |
| 5,620,403 | A | * | 4/1997 | Lundin | 482/96 |
| 5,938,571 | A | * | 8/1999 | Stevens | 482/96 |
| 5,967,955 | A | * | 10/1999 | Westfall et al. | 482/142 |
| 2002/0132706 | A1 | * | 9/2002 | Sleamaker | 482/51 |

* cited by examiner

*Primary Examiner*—Nicholas D. Lucchesi
*Assistant Examiner*—Victor Kenny Hwang
(74) *Attorney, Agent, or Firm*—Troxell Law Office PLLC

(57) ABSTRACT

An interactive exercise apparatus structure comprised of a base, an inclined support structure at the upper extent of the base, and a transport pulley assembly installed above the base. The support structure consists of an arrangement in which one end is on the floor and the other end is angularly positioned on the base. The pull cord is on the floor and the other end is angularly positioned on the base. The pull cord of the transport pulley assembly is respectively wrapped around a first pulley at the lateral end of the upper horizontal bar and positioned onto a second pulley at the bottom end of the reclined body rest buttress rod, following which it is wrapped around a third pulley at the other end of the upper horizontal bar, the two free ends of the pull cord then providing the user extremities for exerting a tugging force.

3 Claims, 7 Drawing Sheets

INTERACTIVE EXERCISE APPARATUS STRUCTURE

BACKGROUND OF THE INVENTION

1) Field of the Invention

The invention herein relates to an interactive exercise structure in which the frame of the support structure consists of a front frame member and rear frame member assembled together and maintained in position by an inserted pin: furthermore, the pull cord of the transport pulley assembly is respectively wrapped around a first pulley, a second pulley, and a third pulley such that the two free ends of the pull cord provide the user extremities for exerting a tugging force; the user sits on the reclined body rest with both hands applying an equal force on the two free ends of the pull cord that causes the reclined body rest to roll reciprocally along the frame and thereby move the exerciser back and forth along with it; as such, the invention herein constitutes an interactive exercise apparatus structure wherein the body weight of the exerciser serves as a load that effectively trains the arms and promotes chest development.

2) Description of the Prior Art

A conventional interactive exercise structure, referring to U.S. Pat. No. 5,967,955, is an apparatus in which the body weight of the exerciser serves as a load to effectively train the arms and promote chest development; however, the structural features of the said patent relating to its collapsibility as achieved by folding the center section upward so that the structure is repostured from an inclined to a vertical state directly differs from approach of the invention herein in that the frame along with its front frame member and rear frame member are folded down horizontally, indicating that the two structures are dissimilar.

SUMMARY OF THE INVENTION

The primary objective of the invention herein is to provide an interactive exercise apparatus structure, wherein the support structure is comprised of a frame and a reclined body rest; the front frame member and a rear frame member of the said frame are assembled together and maintained in position by an inserted pin and, furthermore, the pull cord of the transport pulley assembly is respectively wrapped around a first pulley, a second pulley, and a third pulley such that the two free ends of the pull cord provide the user extremities for exerting a tugging force; the user sits on the reclined body rest with both hands applying an equal force on the two free ends of the pull cord that causes the reclined body rest roll reciprocally along the frame and thereby move the exerciser seated on the reclined body rest back and forth; as such, the invention herein constitutes an interactive exercise apparatus structure in which the body weight of the exerciser serves as a load that effectively trains the arms and promotes chest development.

DETAILED DESCRIPTION OF THE INVENTION

Figure 1:
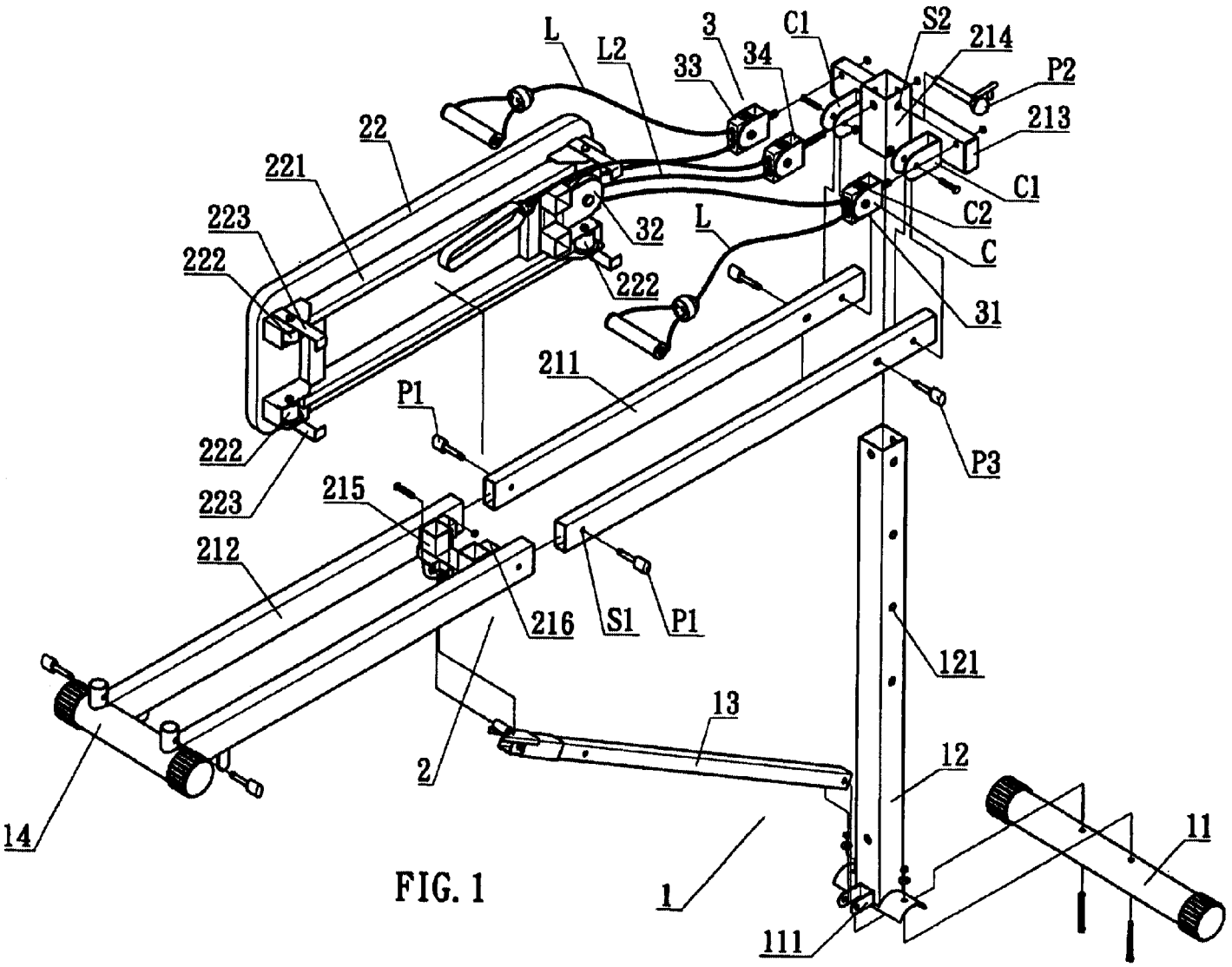
FIG. 1 is an exploded drawing of the invention herein.
Figure 2:
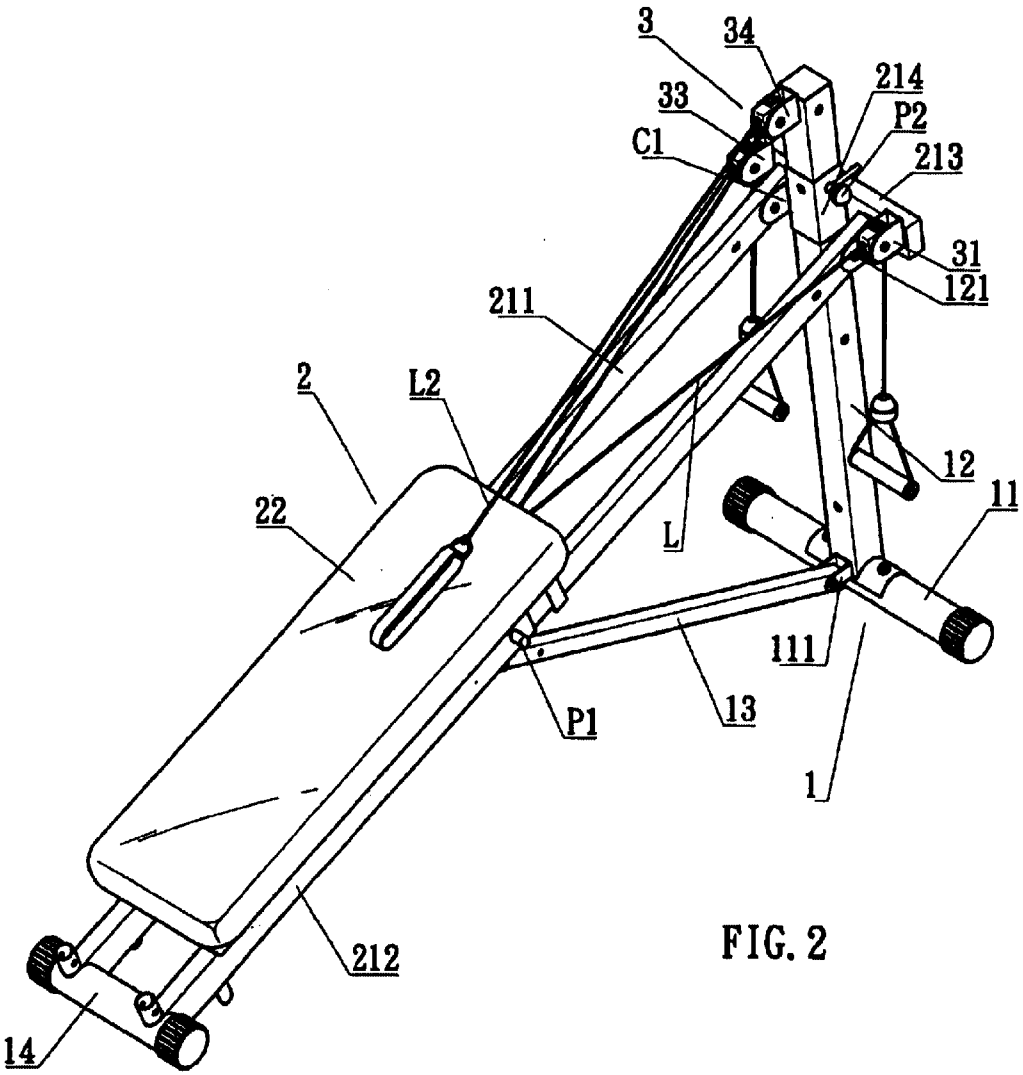
FIG. 2 is an isometric drawing of the invention herein.

As indicated in FIG. 1 and FIG. 2, the invention herein is comprised of a base 1, an inclined support structure 2 at the upper extent of the base 1, and a transport pulley assembly 3 installed above the base 1, of which:

The said base 1 is of a transverse arrangement and consists of a vertical rod 12 having tabs 111 that are perpendicularly disposed at a first end, such that the center of a bottom rod 11 can be attached to the vertical rod 12, as well as a gradient rod 13 with one end hinged onto the tabs 111 of the vertical rod 12 and one end hinged to the lower middle section of the support structure 2; the said vertical rod 12 has suitably disposed at its upper end a mounting hole 121 that provides for propping up the support structure 2.

The said support structure 2 consists of a frame 21 situated on the vertical rod 12, such that one end of the support structure 2 stands on the floor and the other end is angularly placed on the vertical rod 12 of the base 1, and a reclined body rest 22 straddling the upper extent of the frame 21.

The said frame 21 consists of a front frame member 211 and a rear frame member 212; both members are of parallel construction and are assembled together by aligned insertion, with the assembled front frame member 211 and the rear frame member 212 maintained in position by an inserted pin P1; the anterior ends of the front frame member 214 at the middle section of an upper horizontal bar 213 and, furthermore, formed in the sleeve section 214 is a mounting hole S2 that provides for the fitting of the upper horizontal bar 213 onto the vertical rod 12, enabling the mounting hole S2 of the sleeve section 214 to become aligned with the mounting hole 121 of the vertical rod 12 and the insertion of a pin P2 to maintain positioning; situated between the parallel elements of the rear frame member 212 is a stop block 215 and, furthermore, disposed on the stop block 215 is a cushioning pad 216 that forms a restraining section when the buttress rods 221 of the reclined body rest 22 slides on the frame 21.

The said reclined body rest 22 has situated at its bottom end two buttress rods 221 that straddle the frame 21 and, furthermore, the two buttress rods 221 each have roller wheels 222 at their leading and trailing ends where installation to the frame 21 occurs to provide for rolling on the frame 21; a locating element 223 is disposed at the side of each roller wheel 222 on the reclined body rest 22 and, furthermore, each locating element 223 is profiled inward around the front frame member 211 area and outwardly supported against the rear frame member 212 area to maintain the reclined body rest 22 on the frame 21.

The said transport pulley assembly 3 consists of a plurality of pulley units and a pull cord L, each pulley unit includes a block C and a pulley wheel C2 rotationally situated in the block C; the said pull cord L is respectively wrapped around a first pulley 31 at the lateral end of the upper horizontal bar 213 and positioned onto a second pulley 32 at the bottom end of the reclined body rest 22 buttress rod 221, following which it is wrapped around a third pulley 33 at the other end of the upper horizontal bar 213, the two free ends of the pull cord L then providing the user extremities for exerting a tugging force capable of rolling the buttress rod 221 on the frame 21; in addition, appropriately situated at the top end of the vertical rod 12 of the base 1 is a fourth pulley 34 and, furthermore, another pull cord L2 which after being wrapped around the fourth pulley 34 is hooked onto the buttress rod 221 at the bottom end of the reclined body rest 22 to provide the user an additional means of exerting a tugging force capable of rolling the buttress rod 221 on the frame 21.

Figure 3:
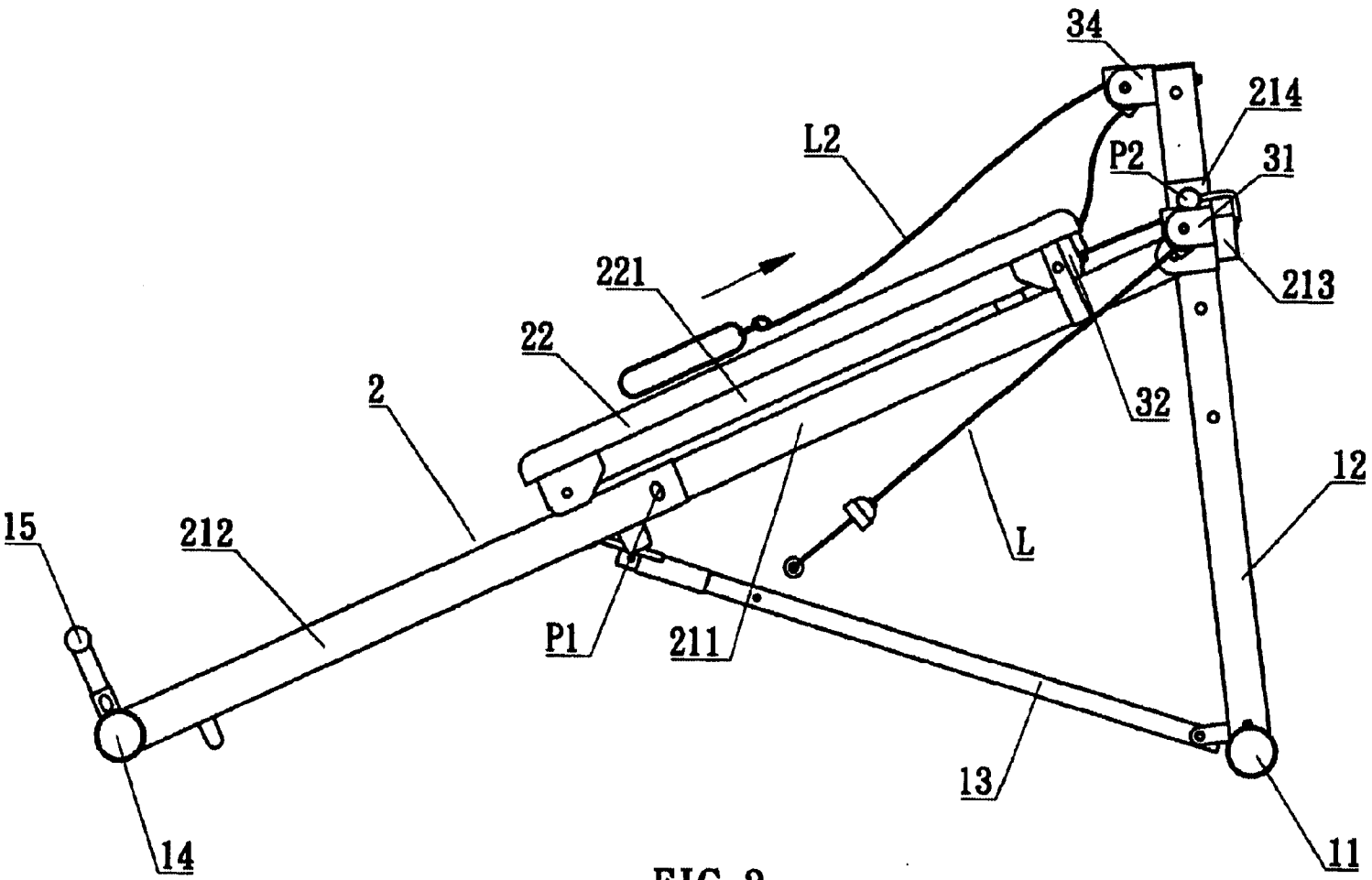
FIG. 3 is an orthographic drawing of the invention herein that illustrates the forward operation of the reclined body rest.
Figure 4:
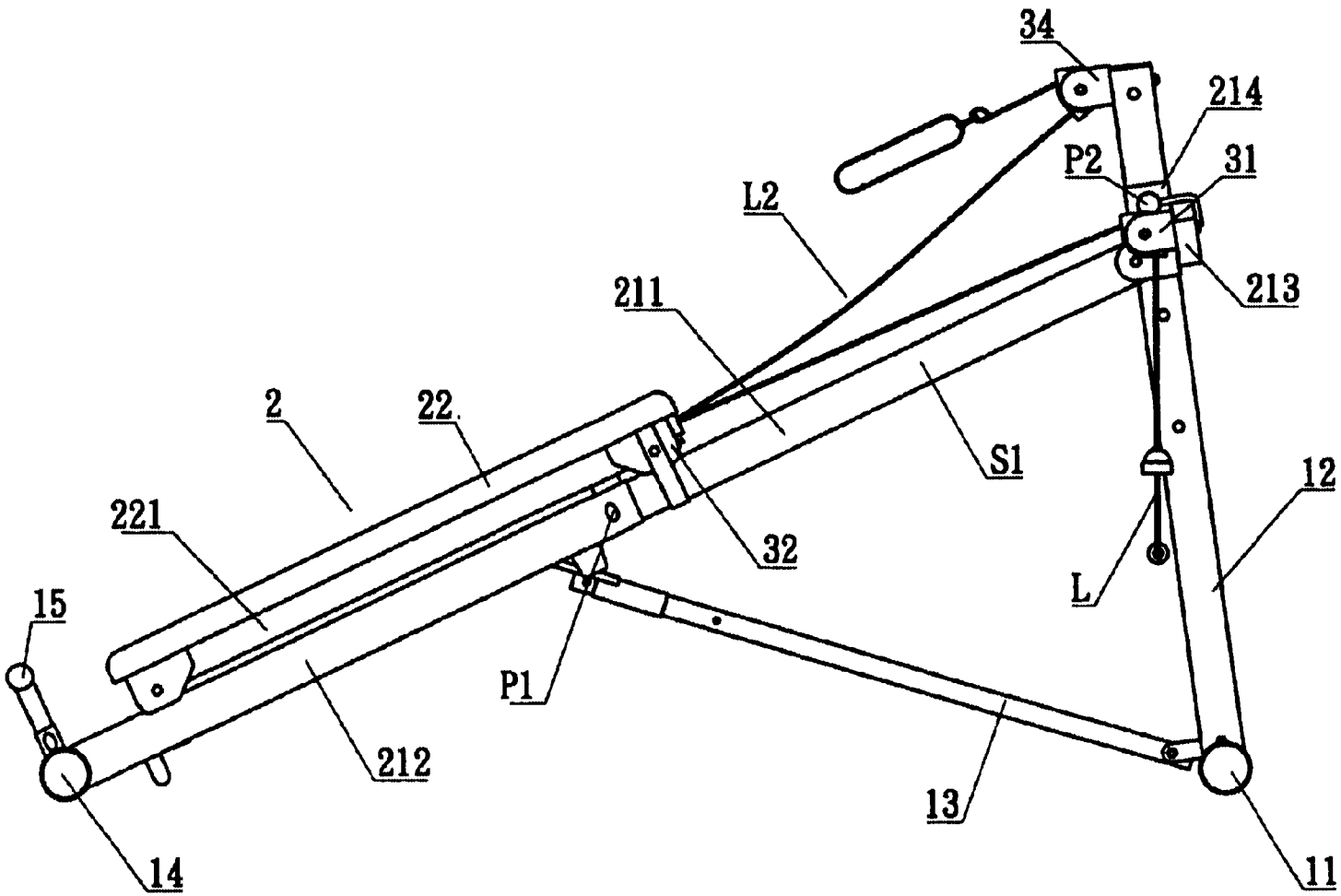
FIG. 4 is an orthographic drawing of the invention herein that illustrates the rearward operation of the reclined body rest.

As indicated in FIG. 3 and FIG. 4, to operate the invention herein, the exerciser sits appropriately on the reclined body rest 22 of the frame 21 with both hands applying an equal force on the two free ends of the pull cord L, at which time the state of equilibrium of the pull cord L is capable of causing tie roller wheels 222 at the bottom end of the buttress rod 221 to travel reciprocally on the frame 21, thereby moving the exerciser seated on the reclined body rest 22 back and forth; as such, the invention herein constitutes an interactive exercise apparatus structure in which the body weight of the exerciser serves as a load that effectively trains the arms and promotes chest development.

Figure 5:
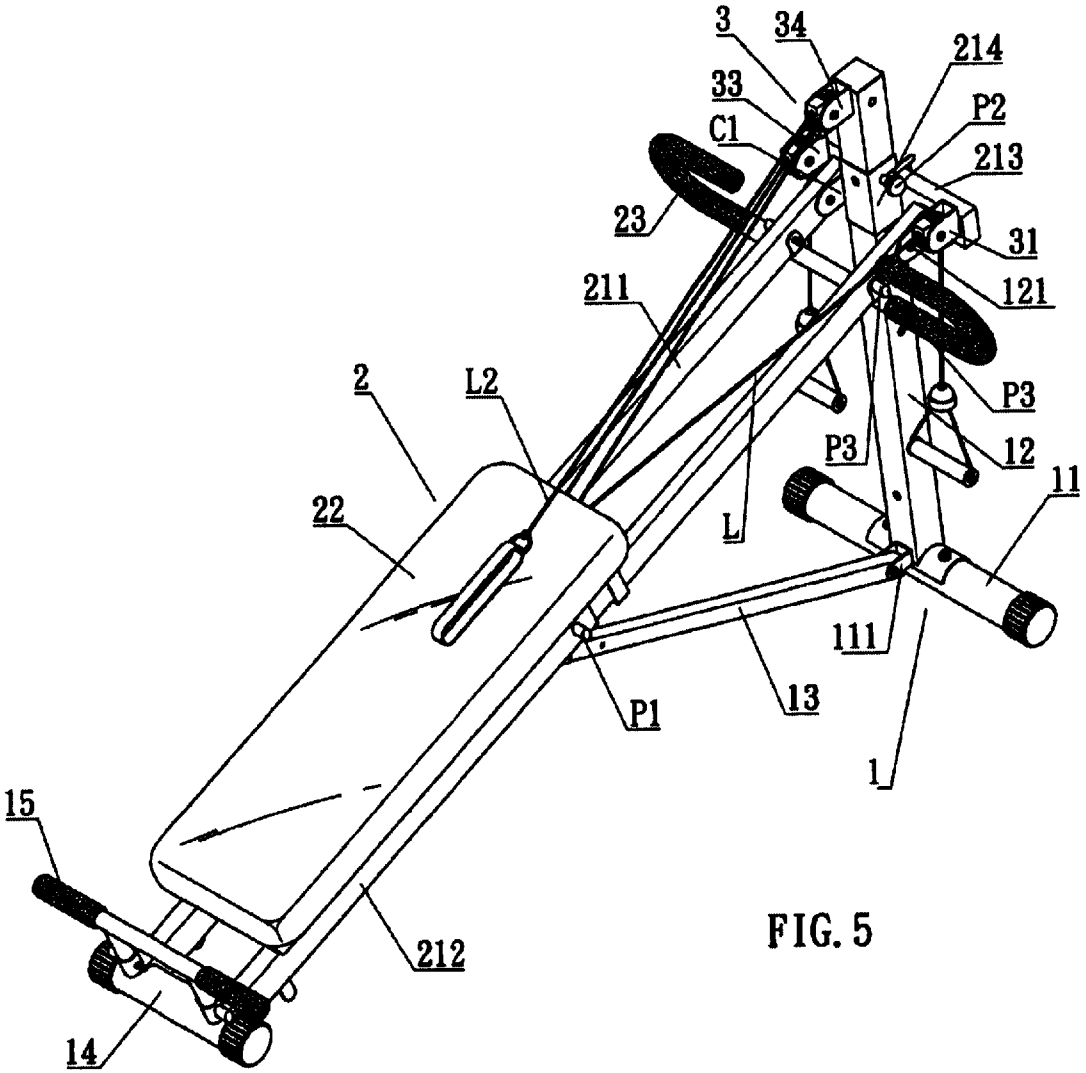
FIG. 5 is an isometric drawing of the invention herein with other accessory equipment assembled to it.

Referring to FIG. 5, the drawing of the invention herein with other exercising equipment accessories assembled to it, an upward curving U-shaped foot rod 23 having its two ends secured by a pin P3 is additionally installed at a suitable position on the front frame member 211 of the frame 21 that allows the user to insert both legs through the space afforded by the said U-shape and thereby appropriately posture the body to perform sit-up exercises on the reclined body rest 22; furthermore, additionally fitted onto on the bottom rod 14 at the lower end of the support structure 2 is an auxiliary hand bar 15 that allows the user to grip the hand bar 15 with two hands to perform push-up exercises.

Figure 6:
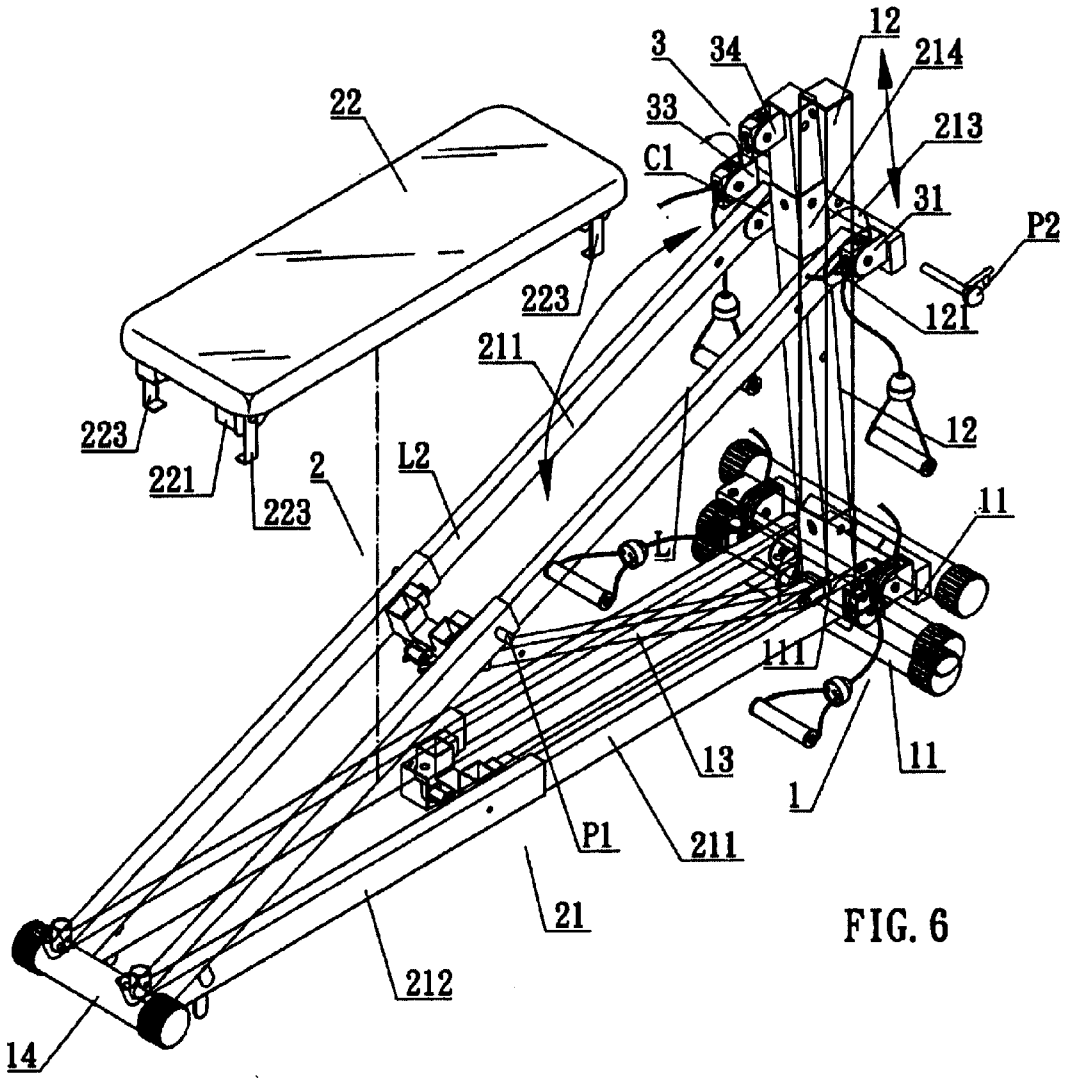
FIG. 6 is an isometric drawing of the invention herein in the folded state.
Figure 7:
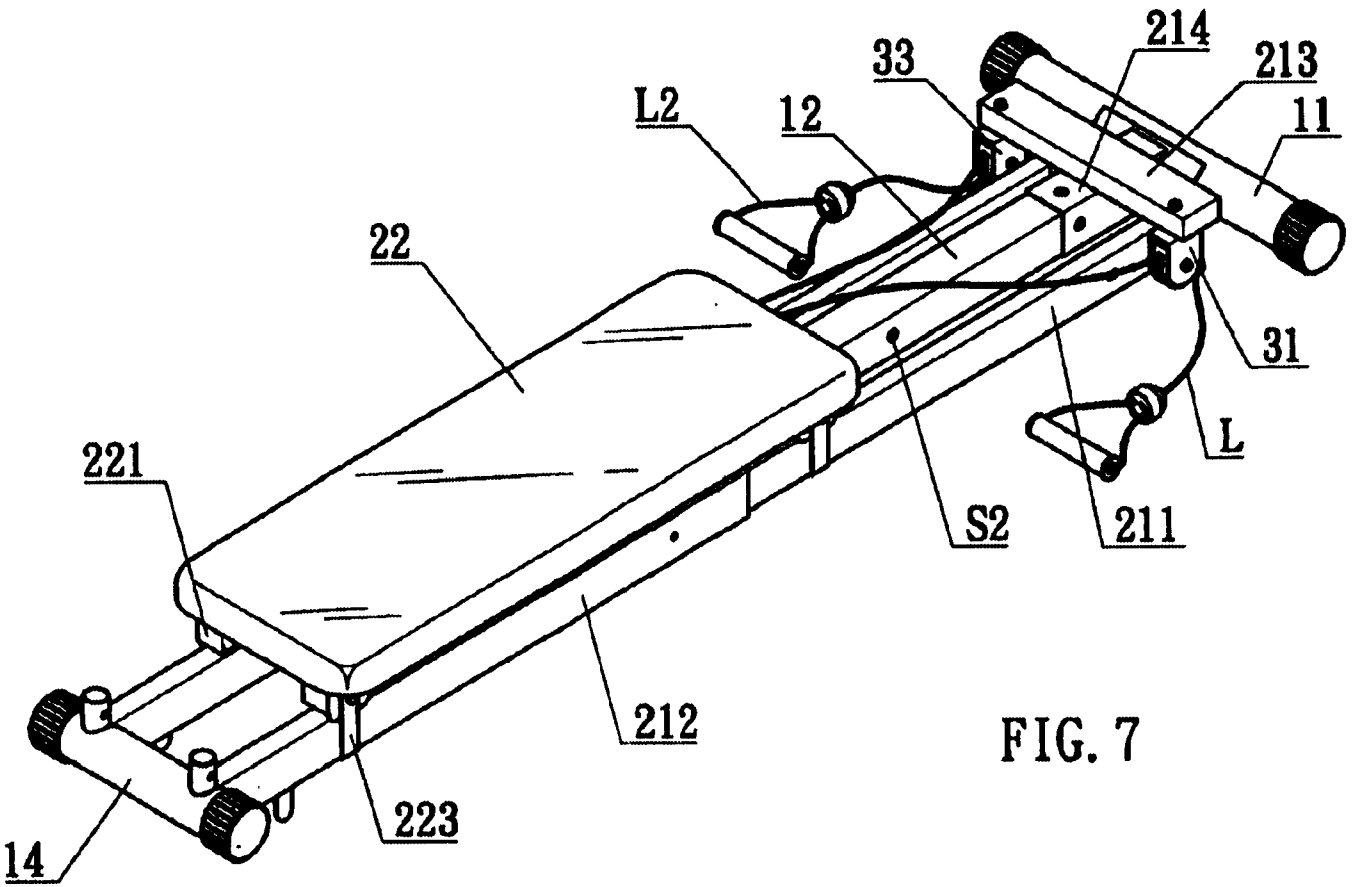
FIG. 7 is an isometric drawing of the invention herein that illustrates the method of folding.

Referring to FIG. 6 and FIG. 7, the drawing of the invention herein in the folded state, the reclined body rest 22 is first removed from the frame 21 and then the pin P2 inserted through the frame 21 and the vertical rod 12 is withdrawn to pivot the frame 21 to its lowest position, while allowing the vertical rod 12 to be turned down and brought into a flat, horizontal arrangement with the frame 21 to thereby fold the exercise apparatus of the invention herein.

What is claimed is:

1. An interactive exercise apparatus structure comprising:

a) a base having:

i) a first bottom rod;

ii) a vertical rod with tabs at a first end and a plurality of first mounting holes extending along a length thereof, the first bottom rod is connected at a center thereof to the first end of the vertical rod;

iii) a gradient bar pivotally connected at first end thereof to the tabs of the vertical rod; and iv) a second bottom bar with an auxiliary handle;

b) an inclined support structure having:

i) a frame including a front frame member and a rear frame member removably connected by a first pin at a first end thereof to a first end of the front frame member, the frame pivotally connected at a middle thereof to a second end of the gradient bar, the rear frame member removably connected at a second end thereof to the second bottom bar;

ii) an upper horizontal bar including a square sleeve section with a second mounting hole and hinge tabs, the square sleeve section located around and positioned on the vertical rod by a second pin inserted through the second mounting hole of the square sleeve and one of the plurality of first mounting holes in the vertical rod, the front frame member pivotally connected at a second end thereof to the hinge tabs of the upper horizontal bar; and iii) a reclined body rest including a pair of buttress rods on a bottom thereof, the inclined body rest slidably positioned on a top of the frame; and c) a transport pulley assembly having a plurality of pulley units and a first pull cord, each of the plurality of pulley units includes a block and a pulley wheel rotatably connected to the block, a first pulley unit and a third pulley unit connected to opposing ends of the upper horizontal bar, a second pulley unit connected to the bottom of the reclined body rest, wherein the first pull cord is wrapped around the wheels of the first pulley unit, the second pulley unit and the third pulley unit with two free ends for exerting a tugging force.

2. The interactive exercise apparatus structure according to claim 1, further comprising a plurality of roller wheels with a locating element for sliding the reclined body rest on the frame, one roller wheel rotatably connected to each of two opposing ends of the each of the pair of buttress rods on the reclined body rest, each locating element extends from a side to a bottom of the frame such that the reclined body rest is slidably secured to the frame.

3. The interactive exercise apparatus structure according to claim 1, further comprising a fourth pulley unit connected to a top of the vertical bar and a second pull cord, the second pull cord wrapped around the wheel of the fourth pulley unit and connected at a first end to the bottom of the reclined body rest, a second end of the second pull cord is free for exerting a tugging force to slide the reclined body rest along the frame.

* * * * *